US006132285A

United States Patent [19]

Feldman

[11] Patent Number: 6,132,285

[45] Date of Patent: Oct. 17, 2000

[54] DOLL SIMULATING YOYO PLAY

[75] Inventor: Joseph Feldman, Los Angeles, Calif.

[73] Assignee: Mattel, Inc., El Segundo

[21] Appl. No.: 09/365,524

[22] Filed: Aug. 2, 1999

[51] Int. Cl.[7] ..... A63H 3/20

[52] U.S. Cl. ..... 446/268; 446/250; 446/330; 446/390

[58] Field of Search ..... 446/250, 251, 446/268, 307, 308, 309, 311, 315, 334, 335, 336, 390

[56] References Cited

U.S. PATENT DOCUMENTS

| | | |
|---|---|---|
| 216,864 | 6/1879 | Kiesele . |
| 1,287,328 | 12/1918 | Jafferian . |
| 1,296,179 | 3/1919 | Goehring . |
| 1,462,090 | 7/1923 | Lindstrom . |
| 2,333,687 | 11/1943 | Shelton . |
| 2,888,776 | 6/1959 | Sauer . |
| 3,184,884 | 5/1965 | Petrucelli . |
| 3,700,384 | 10/1972 | Gardel et al. . |
| 4,576,586 | 3/1986 | Amici et al. ..... 446/315 |
| 6,062,941 | 5/2000 | Cook ..... 446/352 |

*Primary Examiner*—Sam Rimell
*Assistant Examiner*—Jeffrey D. Carlson
*Attorney, Agent, or Firm*—Roy A. Ekstrand

[57] ABSTRACT

A doll includes a torso supporting a pivotally attached arm and a string winding spool. A slide is moveably supported within the torso and is coupled to a button extending outwardly from the rear of the doll torso. A pivotable arm is secured to the torso and is operated through a predetermined pivot angle in response to the vertical movement of the button. A spring urges the button to its upper most position. A string passes through an aperture formed in a dolls arm and is wound partially upon the interior string winding mechanism. The outer end of the string supports a simulated yoyo object. As the button is pressed downwardly against the return spring by the user the arm pivots upwardly and the string winds upon the winding spool raising the yoyo. As the button is released the return spring raises the button allowing the arm to pivot downwardly and unwinding a quantity of the supporting string from the spool causing the simulated yoyo to descend.

13 Claims, 3 Drawing Sheets

DOLL SIMULATING YOYO PLAY

FIELD OF THE INVENTION

This invention relates generally to articulated dolls and particularly to those which utilize an elongated cord or string as part of their play activity.

BACKGROUND OF THE INVENTION

Toy figures, such as dolls and the like, which utilize a string thread or cord as part of a play pattern are well known in the art. Many of such of dolls and toy figures use a string or cord for climbing. Still others use a pullstring mechanism for actuating and powering a toy figure or doll.

For example, U.S. Pat. No. 216,864 issued to Kiesele sets forth a TOY-WHIRL having a toy figure generally resembling a human and having a torso and legs upon which a head is rotatably supported. A rod extend vertically through the head and a portion of the torso and an elongated sting having a pull ring at its outer end extends through a mouth aperture formed in the head and is secured to the rod. The toy is operated by first winding the cord around the rod and thereafter holding the head and alternately pulling the cord and releasing it thereby whirling the lower part and causing it to rotate in opposite directions.

U.S. Pat. No. 1,287,328 issued to Jafferian sets forth a DOLL having a doll torso, arms and legs formed in a common body and a head rotatably supported thereon. An elongated rod is supported within the body and extends vertically from the head to feet of the doll. A chamber is formed within the doll torso and an aperture is formed in the approximate center of the doll torso. A length of string or cord is secured to the head supporting rod and passes outwardly through the aperture. The string is wound upon the rod and thereafter pulled to cause the head and rod to rotate with respect to the body.

U.S. Pat. No. 2,888,776 issued to Sauer sets forth a VERTICALLY MOVABLE DOLL having a toy figure supporting articulated arms and legs and having a pullstring winding mechanism supported within the torso of the doll. The doll head defines an aperture through which a string or cord passes. The interior end of the string or cord is secured to the pullstring mechanism and a portion of the string or cord is wound upon the pullstring mechanism. The outer end of the string or cord is secured to a supporting element. The doll is movable vertically upon the string as the quantity of string wound upon the pullstring mechanism is wound and unwound.

U.S. Pat. No. 2,333,687 issued to Shelton sets forth an ANIMATED TOY having a multiply articulated toy figure supported by a vertical pullstring. The mechanism supporting the toy figure pullstring includes an offset erratic rotating drive which functions to impose an erratic vibratory motion upon the articulated toy figure.

U.S. Pat. No. 1,296,179 issued to Goehirng sets forth a TOY having a toy soldier supporting articulated arms and legs. The arms of the toy figure define simulated hands having apertures formed therein. A pair of cords pass through the hand apertures and are used to manipulate the toy figure.

U.S. Pat. No. 3,184,884 issued to Petrucelli sets forth a ROTATING HEAD-CARRIED TOY having an inverted U-shaped member supporting an upwardly extending post at its top most portion. The post in turn rotatably supports an elongated arm and flexible string having a weighted ball at its outer end. The inverted U-shaped member is warn upon the head of a user and is secured thereto by an elastic band extending beneath the user's chin from either side of the U-shaped member. The ball is caused to rotate about the user's head by skillful manipulation of the user's head.

U.S. Pat. No. 3,700,384 issued to Gardel et al. sets forth a BALLERINA DOLL having a hand operated animated leg, arm and head movement. The movements of the doll simulate those of a ballet dancer. The leg and arm movement is synchronized to have a leg raised while the arms are moving downward toward the leg and to have the arms raised as the leg moves downward a vertical position. The doll is rotated on the toe of the other leg.

While the foregoing described prior art devices have to some extent improved the art and in some instances enjoyed commercial success, there remains nonetheless a continuing need in the art for ever more improved, interesting and amusing toy figures and dolls which utilize a string or cord mechanism.

SUMMARY OF THE INVENTION

Accordingly, it is a general object of the present invention to provide an improved doll. It is a more particular object of the present invention to provide an improved doll which utilizes a pullstring mechanism. It is a still more particular object of the present invention to provide an improved doll which simulates the play pattern commonly associated with an amusement device known generally as a yoyo.

In accordance with the present invention there is provided a doll comprising: a doll body having a torso defining an interior cavity; an arm having an arm passage therethrough; a hand extending from the arm and defining an aperture therein communicating with the arm passage; a spool supported within the interior cavity; a string having a portion wound upon the spool and extending from the spool through the arm passage and the aperture and having an end; an object secured to the end of the string; a button movably supported upon the doll body; and operative means within the interior cavity responsive to movement of the button for alternately increasing and decreasing the portion of the string wound upon the spool to alternately raise and lower the object.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
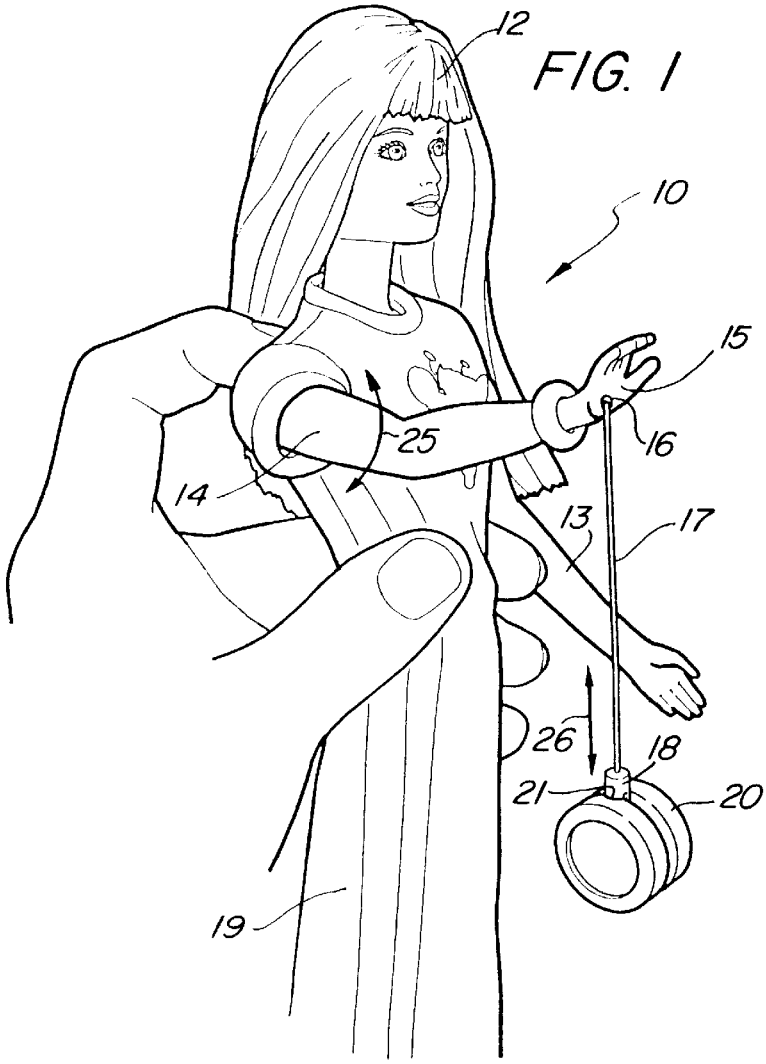
FIG. 1 sets forth a partial perspective view of a doll constructed in accordance with the present invention.

FIG. 1 sets forth a perspective view of a doll constructed in accordance with the present invention and generally referenced by numeral 10. Doll 10 includes a doll body 11 fabricated of molded plastic components or the like and generally resembling a young girl. It will be apparent to those skilled in the art however, that while the embodiment shown in FIG. 1 has been chosen for illustrative purposes, dolls and toy figures having other appearances and aesthetic themes may be utilized without departing from the spirit and scope of the present invention. Doll body 11 includes a head 12 supported in accordance with conventional fabrication techniques together with a pair of pivotally secured arms 13 and 14. Doll body 11 is also covered for the most part by a fabric dress 19 constructed in accordance with conventional fabrication techniques. As is better seen in FIG. 2, doll body 11 supports a rearwardly extending button 31 while dress 19 defines an opening 30 on the rear portions thereof which permits the user to gain access to button 31.

Figure 3:
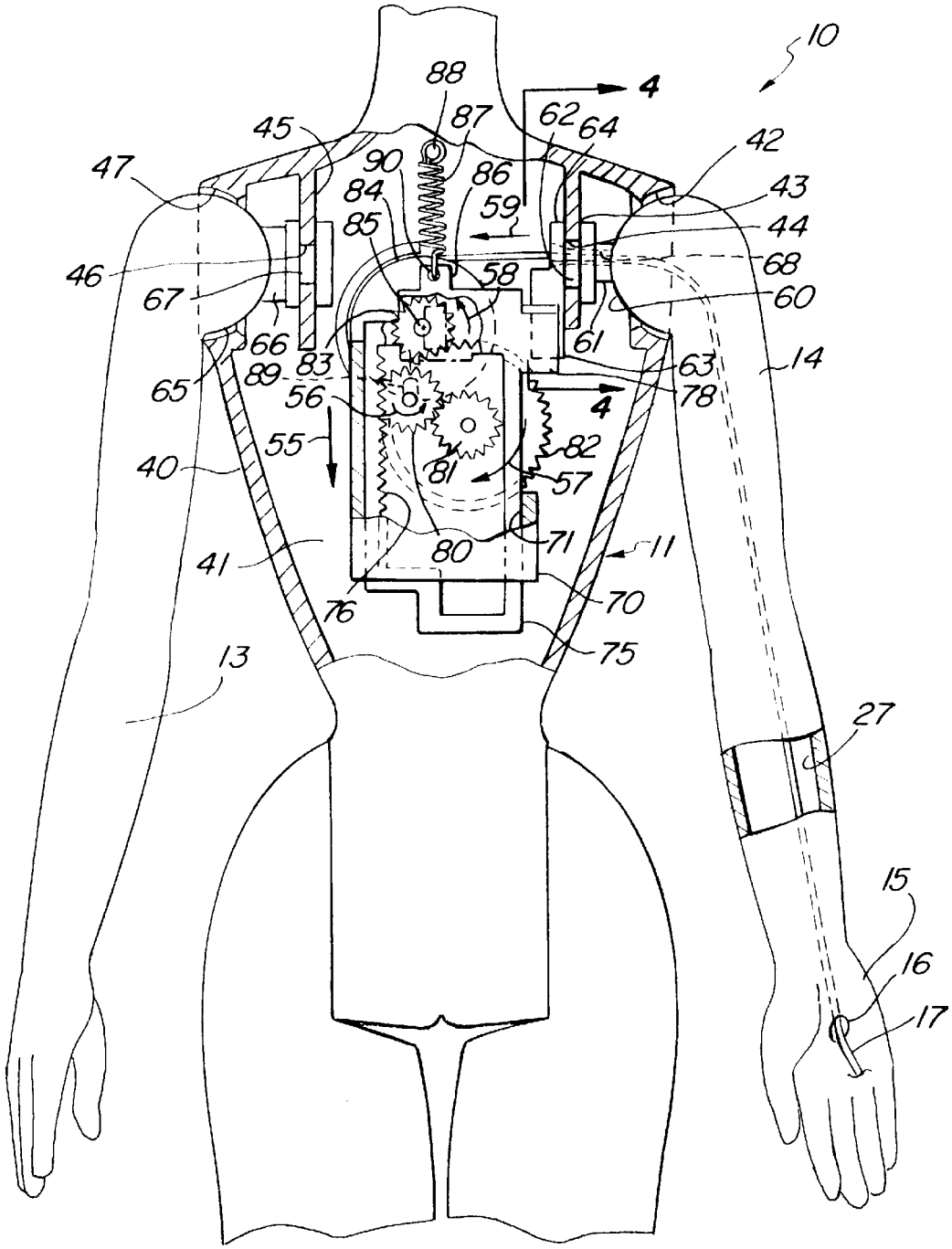
FIG. 3 sets forth a partial rear section view of the present invention doll showing the operative mechanism therein.

Returning to FIG. 1 and in accordance with the present invention, arm 14 of doll body 11 is pivotally supported and movable with respect to doll body 11 in the directions indicated by arrows 25. Also in further accordance with the present invention, arm 14 supports a hand 15 defining an aperture 16 therein. With temporary reference to FIG. 3, it will noted that arm 14 is hollow defining an interior passage 27. A flexible string 17 extends through aperture 16 and as is better seen in FIG. 3 is coupled to a string winding mechanism upon a spool 84. The outer end of string 17 is joined to a clasp 18 which in turn is received a socket 21 formed in simulated yoyo 20.

Figure 2:
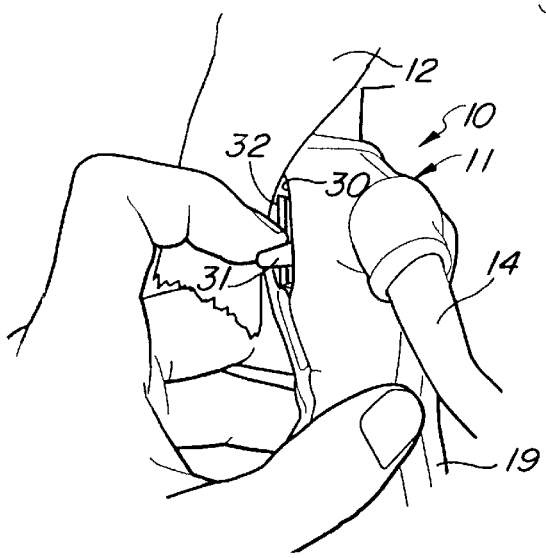
FIG. 2 sets forth a partial rear perspective view of the present invention doll illustrating push-button action thereof.

In operation, the user grips body 11 generally in the manner shown in FIG. 1, placing a finger upon button 31 in the manner seen in FIG. 2. In accordance with the operation of the string winding mechanism set forth below in FIG. 3, and in accordance with the arm moving mechanism sets forth below in FIGS. 4 and 5 both of which are responsive to the user's downward push and release of button 31, the user is able to cause doll 10 to simulate yoyo play patterns. Specifically, as the user forces button 31 (seen in FIG. 2) downwardly, arm 14 is raised slightly and string 17 is drawn through aperture 16 into doll body 11 which in turn raises simulated yoyo 20. Conversely, as the user releases button 31 (seen in FIG. 2), arm 14 pivots downwardly a slight distance and string 17 is allowed to unwind which in turn allows simulated yoyo 20 to descend. Thus, as the user repeatedly pressing button 31 downwardly and releases it, arm 14 moves up and down slightly and yoyo 20 is drawn upwardly toward hand 15 and dropped downwardly simulating typical play pattern of a child user having a conventional yoyo. The speed with which the user presses and releases button 31 (seen in FIG. 2) controls the speed with which arm 14 moves up and down and simulated yoyo 20 rises and descends. The resulting play pattern gives an extremely realistic and amusing activity closely resembling conventional yoyo play.

FIG. 2 sets forth a partial rear perspective view of doll 10 showing manipulation of the activation button for the mechanism described below. As described above, doll 10 includes a body 11 supporting a head 12 and an arm 14. A dress 19 having an opening 30 in the rear portion thereof is received upon body 11 and is conventional in fabrication but for the provisioning of opening 30. A button 31 is coupled to an operative mechanism set forth below in FIG. 3 through 5 in greater detail and extends outwardly through opening 30. Also shown in FIG. 2, is an elongated slot 32 formed in doll body 11 which allows button 31 to extend outwardly from the interior of body 11.

In operation and as described above, the user simply holds doll body 11 in a convenient grip while placing a finger upon button 31 and manipulates button 31 in the above described press and release cycle of activity. The repeated up and down movement of button 31 in turn produces the above described arm and yoyo movement of arm 14 and simulated yoyo 20 (seen in FIG. 1).

Figure 4:
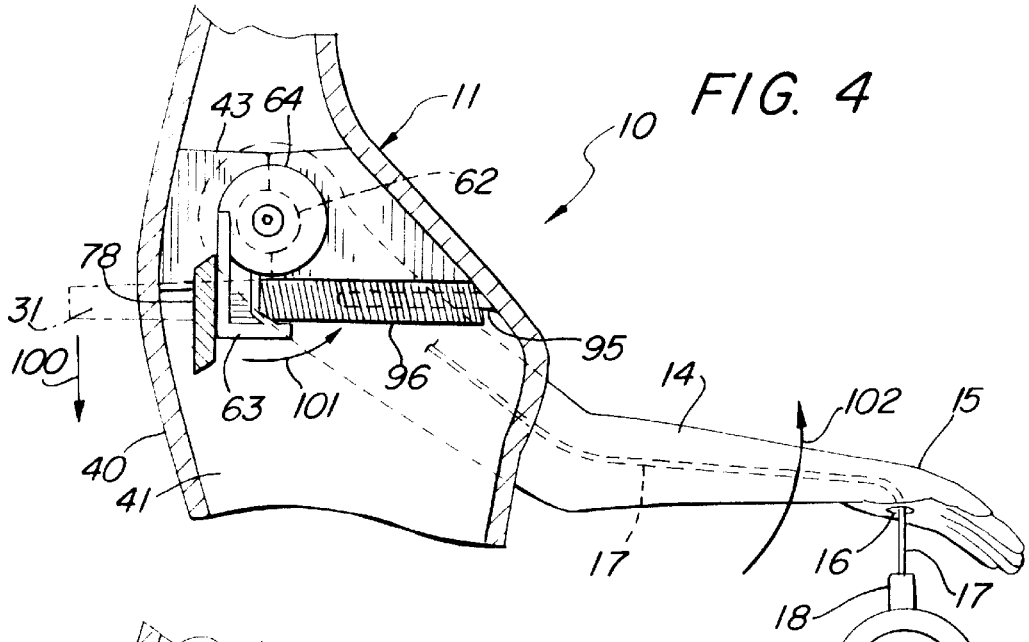
FIG. 4 sets forth a partial side section view of the present invention doll showing the operative mechanism at the end of a downward motion stroke.
Figure 5:
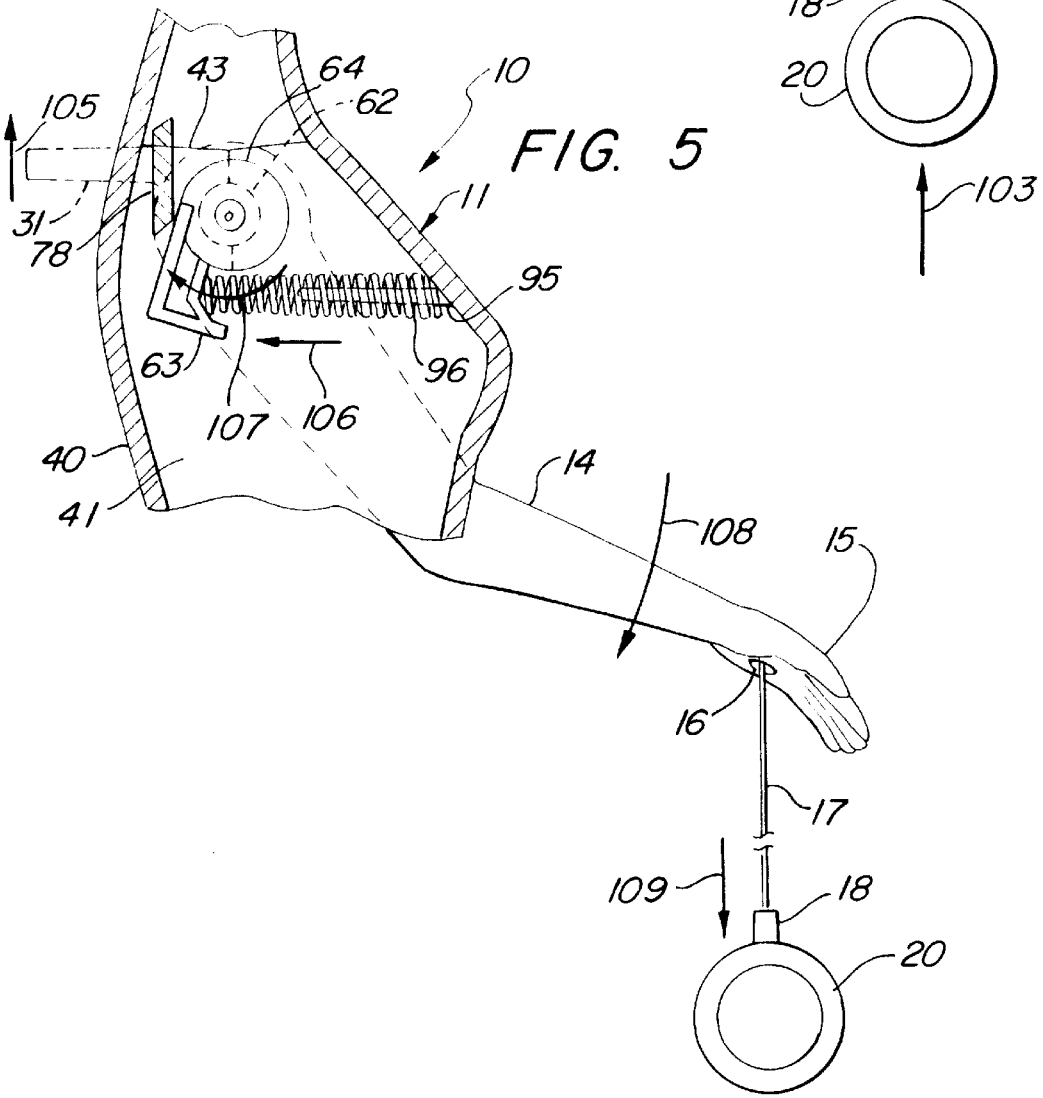
FIG. 5 sets forth a partial section side view of the operative mechanism of the present invention doll at the upper extreme of its motion.

FIG. 3 sets forth a partial section rear view of doll 10 showing the operative mechanism responsive to the above described repeated press and release of button 31 (seen in FIG. 2). Doll 10 includes a doll body 11 having a torso 40 preferably formed of a molded plastic material or the like which is generally hollow and as a result defines an interior cavity 41. Torso 40 further defines a pair of shoulder sockets 42 and 47. A pair of generally planar bearing journals 43 and 45 having respective bearing apertures 44 and 46 are supported in general alignment with sockets 42 and 47 respectively. Torso 40 further includes a slide housing 70 supported in a fixed support within an interior cavity 41 and defining a slide channel 71. A slide 75 is captivated within slide channel 71 and is movable in a sliding vertical travel path. Slide 75 further includes an inwardly facing gear rack 76 and an upwardly extending tab 86. Tab 86 in turn defines an aperture 90 which receives one end of a spring 87. A post 88 supported within interior cavity 41 receives and secures the remaining end of spring 87. A cam 78 which is better seen in FIGS. 4 and 5, is integrally formed with slide 75 and extends outwardly beyond slide housing 70.

A gear 80 is received within a slot 89 formed in slide housing 70 and engages gear rack 76. A gear 81 rotatably supported upon slide housing 70 is joined to a larger diameter gear 82 positioned beneath slide 75. A spool 84 is rotatably supported by a shaft 85 and includes an integrally formed gear 83. Gear 83 is aligned with and engages gear 82. A quantity of string 17 is wound upon spool 84.

Doll 10 further includes an arm 14 defining an interior passage 27 and a ball end 60. Ball end 60 includes a post 61 and a bearing 62. Bearing 62 is rotatably supported within aperture 44 of bearing journal 43. A cam follower 63 is joined to bearing 62. As a result, the combination of cam follower 63, bearing 62, post 61 and ball end 60 of arm 14 are rotatably supported by bearing 62 as a single rotatable element. In further accordance with the present invention, arm 14 supports hand 15 which in turn defines an aperture 16. As mentioned above, a quantity of string 17 is wound upon spool 84. A further portion of string 17 extends outwardly from spool 84 and passes through a passage 68 formed in cam follower 63, bearing 62, post 61 and ball end 60. The outer end of string 17 then further passes downwardly through passage 27 and outwardly from hand 15 outwardly through aperture 16 of hand 15. As seen in FIGS. 3 and 4, string 17 in turn supports a simulated yoyo 20.

For convenience of play pattern and to further enhance the play value of doll 10, arm 13 is also pivotally supported with respect to torso 40. Thus, arm 13 includes a ball end 65, a post 66 and a bearing 67 received within socket 47 and aperture 46 respectively to pivotally support arm 13. It will be noted that arm 13 does not play any direct roll in the yoyo simulation play pattern of the present invention. Accordingly, pivotal support of arm 13 is not essential to the present invention doll.

In operation, the manipulation of button 31 (seen in FIG. 2) by the user moves slide 75 within slide channel 71 of slide housing 70. Correspondingly, the movement of slide 75 moves gear rack 76 against gear 80. It will be noted that the spring tension of spring 87 urges slide 75 upwardly toward post 88. Thus, the normal position of slide 75 within slide housing 70 is its raised position. As the user pushes button 31 (seen in FIG. 2) downwardly against the force of spring 87, slide 75 is moved downwardly within slide channel 71 in the direction indicated by arrow 55. The movement of gear rack 76 in the direction indicated by arrow 55 carries gear 80 downwardly within slot 89 bring gear 80 into engagement with gear 81. As a result, gear rack 76 is coupled to gear 81 during downward movement of slide 75. As slide 75 continues downwardly in the direction indicated by arrow 55, gear 80 is rotated in the direction indicated by arrow 56 which in turn rotates the combination of gears 81 and 82 in the direction indicated by arrow 57. As mentioned above, gear 83 is rotatably supported by shaft 85 and is joined to spool 84. As is also mentioned above, gear 83 engages gear 82. Thus, as gear 82 rotates in the direction indicated by arrow 57, gear 83 and spool 84 are rotated in the direction indicated by arrow 58.

The rotation of spool 84 winds string 17 upon spool 84 drawing string 17 in the direction indicated by arrow 59. Correspondingly, the drawing force upon string 17 draws it upwardly through aperture 16, passage 27 and passage 68. As mentioned above in connection with FIG. 1, the movement of string 17 produces a corresponding movement of simulated yoyo 20 (seen in FIG. 1). Thus, as string 17 is drawn upwardly and wound upon spool 84, yoyo 20 (seen in FIG. 1) is drawn upwardly toward hand 15.

Once the user has pushed button 31 (seen in FIG. 2) to its maximum downward position, the user releases button 31 and the force of spring 87 raises slide 75 upwardly within slide channel 71. This upward movement is opposite in direction to the direction indicated by arrow 55. As slide 75 rises, gear rack 76 carries gear 80 upwardly within slot 89 disengaging gear 80 from gear 81. As a result, the rotation of gear 80 caused by the upward movement of gear rack 86 is not coupled to gears 81 and 82. As a result, the combination of gears 81 and 82 as well as the combination of gear 83 and spool 84 are freely rotatable since they do not engage gear 80 or gear rack 76 in any manner. With spool 84 freely rotatable, the weight of yoyo 20 (seen in FIG. 1) draws string 17 outwardly from aperture 16 of hand 15 unwinding a portion of string 17 which had previously been wound upon spool 84. As a result, simulated yoyo 20 (seen in FIG. 1) moves away from hand 15 and descends.

Thus, as the user repeatedly presses and releases button 31 (seen in FIG. 2), slide 75 is repeatedly driven downwardly in the direction indicated by arrow 55 and returned upwardly by the action of spring 87. Correspondingly, a quantity of string 17 is repeatedly wound upon and drawn from spool 84 producing a rising and descending pattern of movement for simulated yoyo 20 (seen in FIG. 1).

In addition to the movement of simulated yoyo 20 described above, the repeated movement of button 31 (seen in FIG. 2) also raises and lowers arm 14. The portion of the present invention movement apparatus which produces arm motion is set forth below in FIGS. 4 and 5 in greater detail. However, suffice it to note here, the up and down movement of slide 75 produces a corresponding movement of cam 78 against cam follower 63. The movement of cam 78 against cam follower 63 produces repeated pivotal movement of arm 14 in the manner described below.

FIG. 4 sets forth a partial section side view of doll 10 showing the arm movement mechanism and string mechanism supporting simulated yoyo 20. FIG. 4 shows arm 14 of doll 10 in its raises position corresponding to the downward movement of button 31 by the user. It will be recalled that as the user pushes button 31 downwardly the string supported simulated yoyo 20 winds upon its supporting spool while the dolls arm rises slightly.

More specifically doll 10 includes a body 11 having a torso 40 which defines an interior cavity 41. A button 31 movably supported within torso 40 and is coupled to a cam 78. An arm 14 is pivotally secured to torso 40 in the manner seen in FIG. 3 and is pivotally supported within interior cavity 41 by a bearing 62 and flange 64 received by a bearing journal 43. Flange 64 further supports a downwardly extending cam follower 63. Arm 14 further supports a hand 15 having an aperture 16 formed therein. As described above a string 17 passes through aperture 16 and extends upwardly through arm 14 to be wound upon a spool 84 (seen in FIG. 3). The lower end of string 17 is joined to a clasp 18 which in turn is secured to simulated yoyo 20.

A post 95 extends rearwardly from the front interior surface of torso 40 and receives a spring 96. Spring 96 is captivated upon post 95 and cam follower 63. Spring 96 produces a spring force urging cam follower 63 toward a counter clockwise rotation.

In the position shown in FIG. 4, button 31 has been forced downwardly in the direction indicated by arrow 100. This in turn forces cam 78 downwardly against cam follower 63 rotating cam follower 63 against the force of spring 96 in the direction indicated by arrow 101. Because arm 14 is directly coupled to flange 64 and cam follower 63 in the structure shown in FIG. 3, the rotation of cam follower 63 in the direction indicated by arrow 101 pivots arm 14 upwardly about bearing 62 in the direction indicated by arrow 102.

Concurrently and in accordance with the apparatus described in FIG. 3, the downward movement of button 31 also winds string 17 upon spool 84. This winding of string 17 draws a quantity of string 17 upwardly through aperture 16 and inwardly through arm passage 27 (seen in FIG. 3) of arm 14. As a result, simulated yoyo 20 is raised upwardly toward hand 15 in the direction indicated by arrow 103.

As described above in FIG. 3, once the user releases button 31, spring 87 returns slide 75 to its upper most position which in turn raises cam 78 correspondingly. As cam 78 is raises, the force of spring 96 pivots cam follower 63 in the clockwise direction which in turn lowers arm 14.

FIG. 5 shows the section view of FIG. 4 taken along section lines 4—4 in FIG. 3, having button 31 at its raises position. As described above, the raised position of button 31 results from the user having releases button 31 allowing spring 87 (seen in FIG. 3) to return slide 75 and cam 78 to their upper most positions. As can be seen by comparison of FIGS. 4 and 5, the raised position of cam 78 allows cam follower 63 and arm 14 to be pivoted downwardly at the urging of spring 96. Thus FIG. 5 illustrates the opposite end of movement attainable by doll 10.

More specifically, doll 10 includes a body 11 having a torso 40 which defines an interior cavity 41. A button 31 movably supported within torso 40 and is coupled to a cam 78. An arm 14 is pivotally secured to torso 40 in the manner seen in FIG. 3 and is pivotally supported within interior cavity 41 by a bearing 62 and flange 64 received by a bearing journal 43. Flange 64 further supports a downwardly extending cam follower 63. Arm 14 further supports a hand 15 having an aperture 16 formed therein. As described above a string 17 passes through aperture 16 and extends upwardly through arm 14 to be wound upon a spool 84 (seen in FIG.

3). The lower end of string 17 is joined to a clasp 18 which in turn is secured to simulated yoyo 20.

A post 95 extends rearwardly from the front interior surface of torso 40 and receives a spring 96. Spring 96 is captivated upon post 95 and cam follower 63. Spring 96 produces a spring force urging cam follower 63 toward a counter clockwise rotation.

After the user releases button 31, the spring force provided by spring 87 (seen in FIG. 3) raises cam 78 to the position shown in FIG. 5. With cam 78 moved upwardly away from cam follower 63, the force of spring 96 against cam follower 63 in the direction indicated by arrow 106 pivots cam follower 63 in the direction indicated by arrow 107. The direct coupling of cam follower 63 and flange 64 to arm 14 causes arm 14 to pivot downwardly in the direction indicated by arrow 108. Concurrently, the upward movement of button 31 in the direction indicated by arrow 105 operates the spool winding mechanism describe above in FIG. 3 to unwind a portion of string 17 allowing simulated yoyo 20 descend away from hand 15 in the direction indicated by arrow 109.

As a result, the repeated movement by the user of button 31 between its lower position shown in Figure and its raised position shown in FIG. 5 causes arm 14 to undergo an angular movement between the raises position of FIG. 4 and its lowered position in FIG. 5. Correspondingly, the same repeated movement of button 31 between the positions shown in FIGS. 4 and 5 repetitively draws string 17 and simulated yoyo 20 upwardly to the raises position shown in FIG. 4 and allows it to descend to the lowered position shown in FIG. 5.

As the user acquires skill in pressing and releasing button 31 a corresponding skill at simulating yoyo play patterns by doll 10 is achieved. Essentially, the timing for producing optimum results and most realistic appearance is easily mastered by even the youngest of children and amounts to simply allowing the return of button 31 to its raised position following each downward stroke against the button. Once this elementary skill is mastered even the youngest of children is capable of enjoyable, amusing and realistic yoyo play pattern activity.

Figure 6:
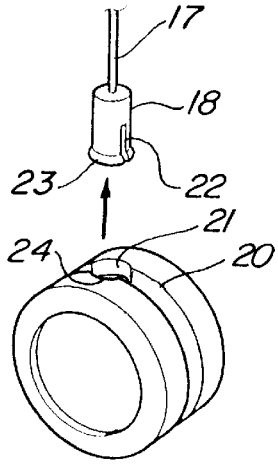
FIG. 6 sets forth a perspective assembly view of a simulated yoyo attachment to the draw string of the present invention doll.

FIG. 6 sets forth a perspective assembly view showing the attachment of simulated yoyo 20 to clasp 18 of string 17. As mentioned above, string 17 is secured to clasp 18 by conventional attachment such as passing the end of string 17 through an appropriate aperture formed in clasp 18 and tying and enlarged knot therein. Alternatively, string 17 may be secured to clasp 18 by the use of conventional adhesives or the like. Clasp 18 defines a slot 22 and an extending lower lip 23. Correspondingly, simulated yoyo 20 defines a socket 21 having an upper edge formed therein. Thus, the insertion of clasp 18 into simulated yoyo 20 is accomplished by simply squeezing the lower portion of clasp 18 to compress slot 22 and allowing lip 23 to be moved past edge 24 as clasp 18 is forced into socket 21. Thereafter, clasp 18 may be removed by essentially reversing the assembly process as clasp 18 is squeezed to compress slot 22 and allow lip 23 to be drawn past edge 24.

Figure 7:
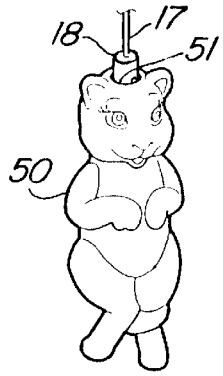
FIG. 7 sets forth a perspective view of an alternative object utilized in place of the simulated yoyo of FIG. 6.

FIG. 7 sets forth an alternative item to be interchangeably utilized in place of simulated yoyo 20. The interchangeable item comprises a figure generally referenced by numeral 50 formed to replicate a fanciful animal or the like. It will be apparent to those skilled in the art, that alternative objects may be utilized in place of FIG. 50 without departing from the spirit and scope of the present invention. FIG. 50 defines a socket 51 substantially identical to socket 21 shown in FIG. 6. Socket 51 receives clasp 18 in the same manner described above for the insertion and removal of clasp 18 from socket 21.

What has been shown is a novel doll having an amusing and entertaining yoyo play pattern which is easily and inexpensively fabricated. The novel doll shown is easily manipulated by young children and provides an amusing and entertaining play pattern.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which claimed is:

1. A doll comprising:

a doll body having a torso defining an interior cavity;

an arm having an arm passage therethrough;

a hand extending from said arm and defining an aperture therein communicating with said arm passage;

a spool supported within said interior cavity;

a string having a portion wound upon said spool and extending from said spool through said arm passage and said aperture and having an end;

an object secured to said end of said string;

a button movably supported upon said doll body; and operative means within said interior cavity responsive to movement of said button for alternately increasing and decreasing said portion of said string wound upon said spool to alternately raise and lower said object.

2. The doll set forth in claim 1 wherein said operative means further includes:

means for pivotally supporting said arm upon said torso; and means for pivoting said arm alternately up and down as said string is alternately wound and unwound upon said spool.

3. The doll set forth in claim 2 wherein said object is a simulated yoyo.

4. The doll set forth in claim 2 wherein said object is a toy figure.

5. A doll comprising:

a doll body having a torso defining and interior cavity and having a pivotally supported arm defining an arm passage and a hand defining an aperture therein;

a string extending through said aperture and said arm passage into said interior cavity and having a first end within said interior cavity and a second end extending downwardly from said hand;

an object secured to said second end; and user operative means supported within said interior cavity for alternately drawing a portion of said string through said aperture and said arm passage into said interior cavity to raise said object toward said hand and feeding a portion of said string outwardly from said interior cavity through said arm passage and aperture to lower said object.

6. The doll set forth in claim 5 wherein said user operated means includes:

a slide movably supported within said interior cavity;

a user accessible button for moving said slide;

a spool having said first end secured thereto and a portion of said string wound thereon; and gear means coupled between said slide and said spool for rotating said spool as said slide is moved.

7. The doll set forth in claim 6 wherein said gear means includes:

a gear rack formed on said slide;

a first gear joined to said spool; and a plurality of coupling gears coupled between said gear rack and said first gear.

8. The doll set forth in claim 7 wherein said user operated means includes:

a cam extending from said slide;

a cam follower coupled to said arm, said cam follower being pivoted as said slide moves said cam against said cam follower; and a first return spring coupled to said slide urging said slide upwardly.

9. The doll set forth in claim 8 wherein said user operated means includes a second return spring urging said cam follower against said cam.

10. The doll set forth in claim 6 wherein said user operated means includes:

a cam extending from said slide;

a cam follower coupled to said arm, said cam follower being pivoted as said slide moves said cam against said cam follower; and a first return spring coupled to said slide urging said slide upwardly.

11. The doll set forth in claim 10 wherein said user operated means includes a second return spring urging said cam follower against said cam.

12. The doll set forth in claim 5 wherein said object is a simulated yoyo.

13. The doll set forth in claim 5 wherein said object is a toy figure.

* * * * *